US005832796A

United States Patent [19]

Chopra

[11] Patent Number: 5,832,796

[45] Date of Patent: Nov. 10, 1998

[54] POWER TOOL ATTACHMENT

[76] Inventor: Kewal K. Chopra, 39235 Iris Ct., Sterling Heights, Macomb County, Mich. 48310

[21] Appl. No.: 816,370

[22] Filed: Mar. 7, 1997

[51] Int. Cl.[6] ..... B25B 23/14

[52] U.S. Cl. ..... 81/467; 81/125

[58] Field of Search ..... 81/120, 121.1, 81/125, 467, 429

[56] References Cited

U.S. PATENT DOCUMENTS

| | | | |
|---|---|---|---|
| 861,030 | 7/1907 | Hansen | 81/120 |
| 2,959,995 | 11/1960 | Linden | 81/120 |
| 3,397,602 | 8/1968 | Estep et al. | 81/125 |
| 3,787,948 | 1/1974 | Runge | 81/121.1 |
| 4,357,845 | 11/1982 | Cornia | 81/125 |
| 4,687,392 | 8/1987 | Bidwell | 81/475 |
| 5,253,551 | 10/1993 | DeVaughn | 81/3.09 |
| 5,347,892 | 9/1994 | Moetteli | 81/125 |
| 5,396,819 | 3/1995 | Bradley | 81/125 |
| 5,507,211 | 4/1996 | Wagner | 81/472 |

*Primary Examiner*—David A. Scherbel
*Assistant Examiner*—Joni B. Danganan
*Attorney, Agent, or Firm*—Peter A. Taucher; Gail S. Soderling

[57] ABSTRACT

An attachment for installing a solderless connector to wire ends to form an electrical connection using with a rotary hand held tool is described. The attachment has a spindle member held by the tool. The spindle has a cylindrical member attached to the spindle having a frustoconical opening sized to accept and surround a portion of a solderless connector. The frustoconical opening has a plurality of detents which hold the solderless connector firmly and apply sufficient torque to the solderless connector to twist the wires inserted into the solderless connector together when the solderless connector is rotated by the tool. The detents will release their grasp on the solderless connector when sufficient twisting has been applied to the wires to electrically connect the individual wires but prior to the point at which the wires are twisted beyond their elastic limit.

1 Claim, 2 Drawing Sheets

POWER TOOL ATTACHMENT

GOVERNMENT INTEREST

The invention described here may be made, used and licensed by for governmental purposes without paying me any royalty.

BACKGROUND OF THE INVENTION

1. Field of the Invention

In one aspect this invention relates to hand held power tools. In a further aspect, this invention relates to an attachment for use with hand held power tools to minimize working time. In yet a further aspect, this invention relates to hand tools useful with solderless electrical connectors.

2. Prior Art

In general, various attachments are produced for use with a hand held tool such as an electric screwdriver or variable speed drill. The attachments include screwdriver bits in various sizes, drivers for nuts, and drivers for other types of threaded fasteners having a head suitable for being engaged by a driver. Such devices cover a host of possible uses. However devices are not presently available for use in electrical construction. Electrical installation requires the use of a large number of solderless connectors to make the necessary electrically sound connections required to distribute electricity throughout a building to the various outlets and fixtures. Dozens of connections are required for the average house and thousands for larger commercial buildings. Each connection requires that the ends of the wires to be joined be stripped of insulation, the wire ends be brought close together, and a solderless connector placed over the wire ends and twisted until the wires are firmly consolidated by the connector to form an electrical connection. It is apparent that where a large number of connections are required the physical effort in twisting the connectors will become a burden over the course of a working day. Further, the connectors should not be over twisted since over twisting will break one or more of the wires in the connector ruining the connector and the desired connection. This wastes time and can create possible hazards. It would be desirable to provide a tool which can twist the solderless connector to consolidate the wires yet which will tend to release the connector when a maximum torque is reached so the connector is not over twisted.

SUMMARY OF THE INVENTION

Briefly, the present invention provides an attachment for installing a solderless connector using a rotary hand held tool such as an electric screwdriver. The attachment has a spindle member which is held by the rotary tool with a cylindrical member attached to the end of the spindle opposite the rotary tool. The cylindrical member has a frustoconical opening sized to accept and surround a portion of a solderless connector; the frustoconical opening having a plurality of detents which will hold the solderless connector firmly and apply sufficient torque to the solderless connector to twist wires inserted into the connector together to form an electrically sound connection. The detents will release their grasp on the solderless connector when sufficient twisting has been applied to the wires to electrically connect the individual wires but prior to the point at which the wires are twisted beyond their elastic limit.

DETAILED DESCRIPTION

Figure 1:
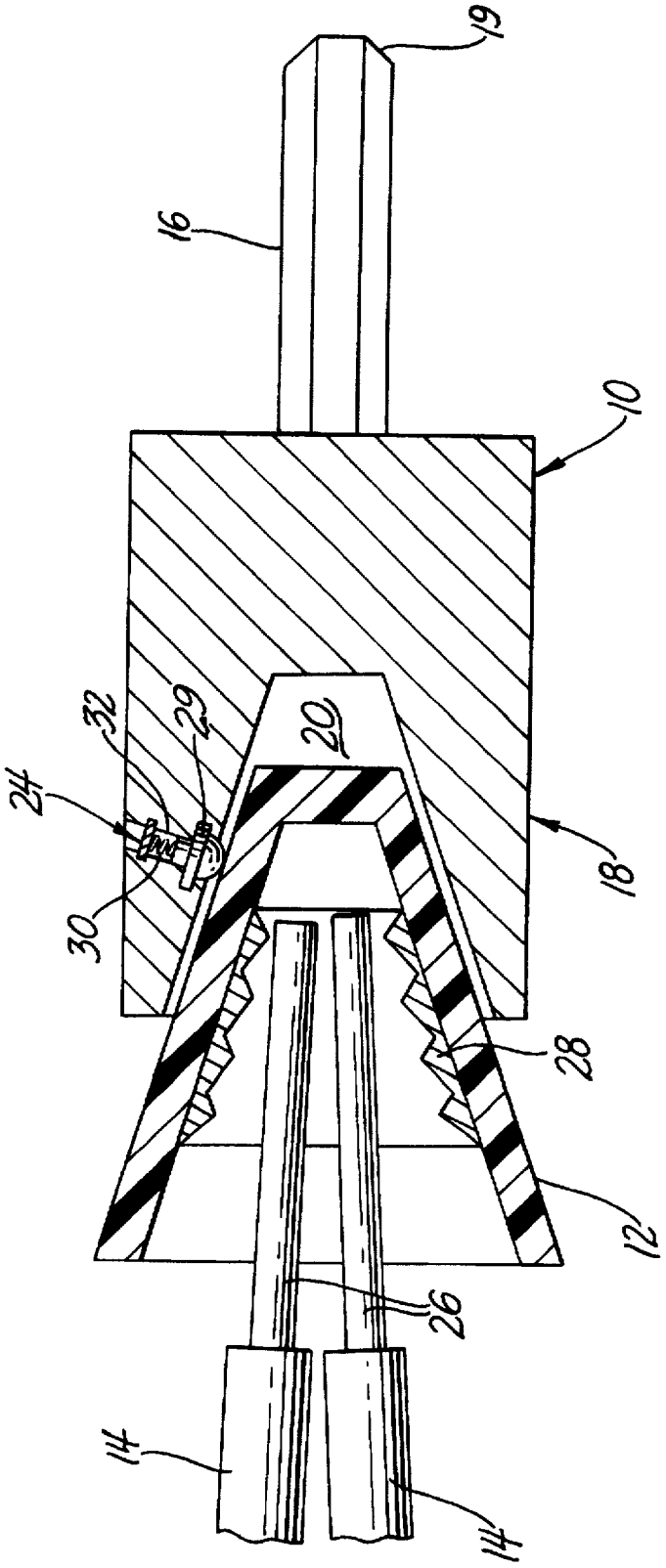
FIG. 1 shows one attachment according to this invention in partial section.

Referring to the accompanying drawing in which like numerals refer to like parts and initially to FIG. 1, an attachment 10 for installing a solderless connector 12 can be used to join a plurality of individual wires 14 to form a sound electrical connection as will be described later. The attachment 10 is designed to be inserted into a rotary hand held tool (not shown) the rotary tool having a chuck for holding attachments. The attachment 10 has a spindle 16 with a first end 19 adapted to be inserted in the chuck, the spindle 16 being engaged and held by the chuck. A second end of the spindle 16 has a cylindrical member 18 attached thereto. The cylindrical member 18 has a frustoconical cavity 20 formed therein with the base, larger diameter, portion of the frustoconical cavity being on the face of the cylinder 18 opposite the spindle 16 and the smaller diameter portion being contained within the cylinder. The frustoconical cavity 20 is sized to accept and surround at least a portion of the closed end of the solderless electrical connector 12, the cylindrical member 18 having a plurality of detents 24 arranged about the periphery of the frustoconical cavity 20, the detents having sufficient grasping force to hold the solderless connector 12 firmly within the frustoconical cavity. The detents of FIG. 1 will hold the solderless connector 12 firmly as the bare ends 26 of the wires 14 are inserted into the connector. As the solderless connector 12 is twisted by the rotary tool, a helical metal insert 28 will grab and twist the wire ends 26 around each other to form an electrically conductive joint between the wires and the connector. The detents 24 of FIG. 1, have a blade member 29 which is biased by a spring 30 into the frustoconical cavity 20. Since most solderless connectors 12 have a plurality of striations, not shown, the blade 29 can engage the striations to apply sufficient torque to the solderless connector 12 to twist the wire ends 26 together. However as the amount of torque increases the detents 24 will be forced out of the frustoconical cavity 20 into a detent cavity 32 formed in the body of the cylinder 18 thereby releasing the detent's grasp on the solderless connector prior to the point at which the wires have been twisted beyond their elastic limit which would ruin the joint and render the connector useless.

Figure 2:
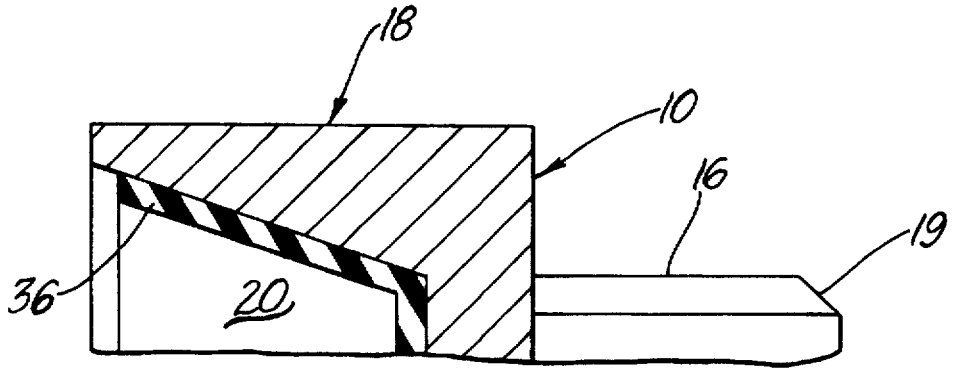
FIG. 2 shows a second embodiment of this invention.

FIG. 2 shows a second embodiment of this invention where the means for holding the solderless connector 12 is an elastomeric material cone 36 made from a material such as polyurethane or similar foam. In using this embodiment, the solderless connector would be inserted until it is frictionally engaged by the elastomeric material cone 36 which will serve the functions of holding and torquing the solderless connector 12 until the wires are properly consolidated.

Figure 3:
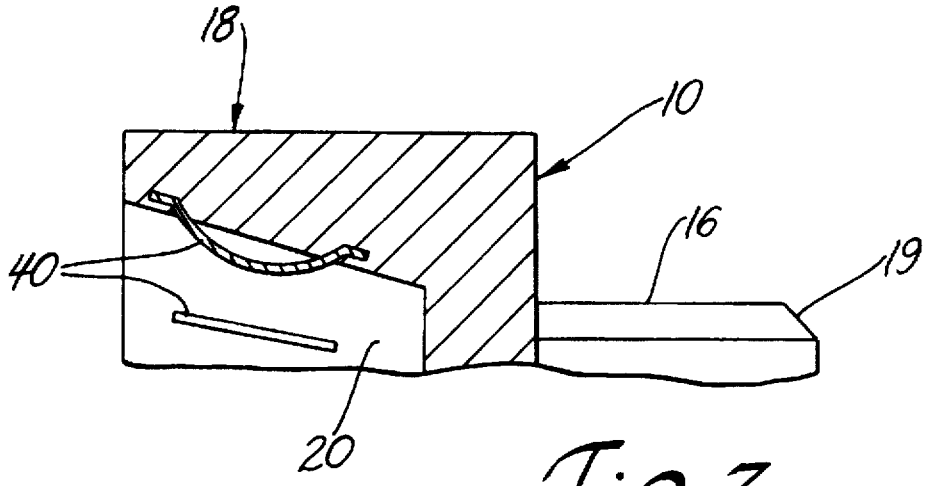
FIG. 3 shows a third embodiment of this invention.

FIG. 3 shows a second detent embodiment where the cylinder 18 has a plurality of bow shaped metal spring members 40 which are formed of a flexible material such as spring steel or the like. The spring members 40 have their ends embedded in the cylinder and are curved or bowed so as to extend into the cavity 20 where they will engage the striations on the solderless connector and provide a gripping force sufficient to hold the solderless connector in the cavity and apply sufficient torque to twist the wires without destroying the connection.

Various alterations and modifications will become apparent to those skilled in the art without departing from the scope and spirit of this invention and it is understood this invention is limited only by the following claims.

What is claimed is:

1. An attachment for installing a solderless electrical connector having a closed end on a plurality of individual wires, the attachment designed to be used with a rotary, hand held tool having a chuck for holding attachments, the attachment including: a spindle member having a first end adapted to engage and be held by the chuck and a second end; a cylindrical member attached to the second end of the spindle, the cylindrical member having a frustoconical cavity formed in the end of the cylindrical member opposite the spindle, the frustoconical cavity being sized to accept and surround at least a portion of the closed end of the solderless electrical connector, the frustoconical cavity having at least one retention means located therein, each retention means is a bow shaped flexible metal member with a curved center section, the metal member having its ends firmly embedded in the cylindrical member and the center curved section extending into the frustoconical cavity to engage the solderless connector, the center curved section having sufficient grasping force to hold the solderless connector firmly within the frustoconical cavity and apply sufficient torque to the solderless connector when the rotary tool is activated to twist the wires inserted into the solderless connector together, yet which will release the grasping force on the solderless connector when sufficient twisting has been applied to the wires to electrically connect the individual wires to prevent twisting the wires beyond their elastic limit.

* * * * *